US005350078A

United States Patent [19]

Potts et al.

[11] Patent Number: 5,350,078

[45] Date of Patent: Sep. 27, 1994

[54] BEVERAGE BOTTLE

[75] Inventors: Jo Lee B. Potts; Joann H. Miller, both of Bradenton; Marvin W. Hodge; Griscom Bettle, III, both of Sarasota, all of Fla.

[73] Assignee: Tropicana Products, Inc., Bradenton, Fla.

[21] Appl. No.: 950,466

[22] Filed: Sep. 24, 1992

[51] Int. Cl.[5] ..... B65D 23/10

[52] U.S. Cl. ..... 215/100 A; 220/771

[58] Field of Search ..... D9/541, 543, 526; 215/250, 10, 1 C, 100 A; 220/771, 772

[56] References Cited

U.S. PATENT DOCUMENTS

| | | | |
|---|---|---|---|
| D. 134,077 | 10/1942 | Clark | D9/541 |
| D. 178,258 | 7/1956 | North | D9/541 |
| D. 178,259 | 7/1956 | North | D9/541 |
| D. 214,429 | 6/1969 | Josephsen et al. | D9/541 |
| D. 227,343 | 6/1973 | Finkel | D9/541 |
| D. 234,019 | 12/1974 | D'Alo | D9/543 X |
| D. 269,948 | 8/1983 | Janssen | D9/543 X |
| D. 272,889 | 3/1984 | Walton | D9/543 X |
| D. 305,980 | 2/1990 | Binder et al. | D9/543 |
| D. 308,631 | 6/1990 | Burns et al. | D9/543 X |
| D. 309,080 | 7/1990 | Buchholz | D9/543 |
| D. 317,122 | 5/1991 | Owen | D9/543 |
| D. 321,320 | 11/1991 | Halm | D9/526 |
| 853,887 | 5/1907 | La Tremouille et al. | D9/541 X |
| 2,920,777 | 1/1960 | Cole | 215/10 X |
| 3,536,500 | 10/1970 | Cleereman et al. | 215/1 C X |
| 3,537,498 | 11/1970 | St Amand | 215/100 A X |
| 3,923,185 | 12/1975 | Choski et al. | 215/1 C X |
| 4,308,955 | 1/1982 | Schieser et al. | 215/10 X |
| 4,721,218 | 1/1988 | Gregory et al. | 215/258 X |
| 4,805,792 | 2/1989 | Lecinski, Jr. | 215/258 X |
| 5,027,964 | 7/1991 | Banich, Sr. | 215/258 X |

*Primary Examiner*—Sue A. Weaver

*Attorney, Agent, or Firm*—Kane, Dalsimer, Sullivan, Kurucz, Levy, Eisele and Richard

[57] ABSTRACT

A plastic bottle for beverages includes a body made of several straight or planar sidewalls, some of which are provided with arcuate grooves forming a finger grip. The bottle is also provided with a closure threadedly mounted so that it can be removed at will for dispensing a beverage. The container can be easily held during beverage dispensal by the finger grips.

15 Claims, 6 Drawing Sheets

BEVERAGE BOTTLE

BACKGROUND OF THE INVENTION

A. Field of Invention

This invention pertains to an improved bottle particularly suited for dispensing beverages and more particularly to a beverage bottle shaped and constructed for easy opening/closing and dispensing of its contents, said bottle having a volume of about 1.5 liters.

B. Description of the Prior Art

Various beverages including fruit juices, fruit drinks or the like are distributed to the general public principally in either glass bottles, or carton containers. While glass bottles enjoy some popularity with the public, they are expensive to manufacture, they break easily and they are heavy.

Another container used for dispensing beverages is a cardboard container normally having a gabled top formed by the walls of the container being folded and sealed along a horizontal seam. The container is opened by separating the seam thereby forming a spout. Alternatively a circular mouth was provided on the gabled top closed with a turning cap. Carton containers are undesirable because they are difficult to shape and are made of laminated sheets of different materials and therefore are difficult to recycle.

When a group of consumers was asked for their opinion regarding carton containers, they indicated that they bought these containers because there was not a convenient alternative. Consumers also indicated that carton containers were advantageous because they fit well on grocery shelves, are space efficient and are easy to use once the customers grew accustomed to handling them. The customers however also indicated that carton container were undesirable because they were hard to grasp and two hands were required to shake them safely and efficiently. The cartons with horizontal seals were found to be additionally undesirable because they lacked tamper-evident indicia, they were not reclosable, and after several uses, the seams became soggy and dripped. The spout also makes recycling more difficult. The cartons with a pour mouth were found to be additionally undesirable because on the first pour they gurgled, the caps were too small and therefore too hard to open, and the gable got in the way of the cap during the opening step.

Existing plastic containers are either hard to hold and pour from such as soda and water bottles or they are very expensive with integrated handles.

OBJECTIVES AND SUMMARY OF THE INVENTION

In view of the above-mentioned disadvantages of the prior art, it is an objective of the present invention to provide a beverage container of a desired volume which is easily opened, handled, poured and reclosed.

A further objective is to provide a container which can be molded of plastic material.

Yet another objective is to provide a container which can be easily and efficiently packed into boxes for shipping and storing.

More specifically, the present inventors designed a beverage container with the following desirable characteristics:

It is easy to handle;

It is reclosable;

Has external tampered-evident indicia;

Has a convenient size and shape;

Makes optimal use of space;

Can be molded from PET or HDPE;

When gripped, expands in contained volume and thereby reduces the risk of squirting;

Can be used in different orientations for different products thereby providing ready product identification.

Additionally, the inventors designed a beverage container having a unique look suggesting to the customer freshness, convenience, up-to-dateness and innovativeness but which was at the same time friendly, familiar and comfortable to use.

Other objectives and advantages of the invention shall become apparent from the following description.

Briefly, a container constructed in accordance with this invention includes a body formed of several substantially planar sidewalls, some of which are formed with a horizontal groove. The horizontal grooves cooperate to form a finger grip on the bottle. The bottle terminates in a neck and a closure attached thereto. The bottle is preferably molded of a plastic material.

DETAILED DESCRIPTION OF THE INVENTION

Figure 5:
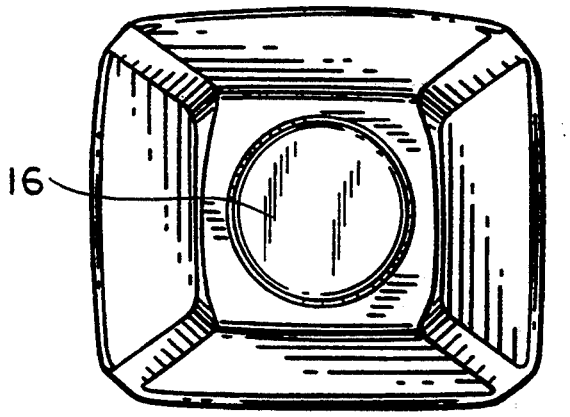
FIG. 5 shows a top view of the bottle of FIG. 1.
Figure 6:
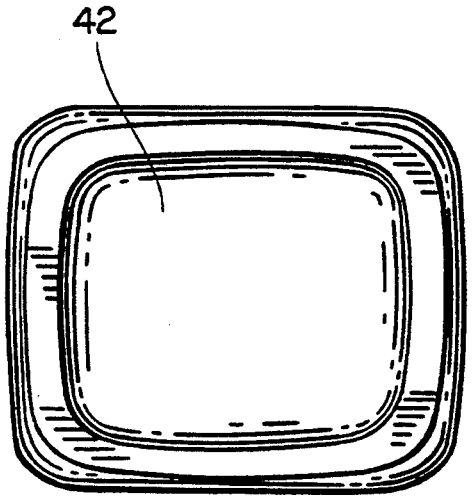
FIG. 6 shows a bottom view of the bottle of FIG. 1.
Figure 7:
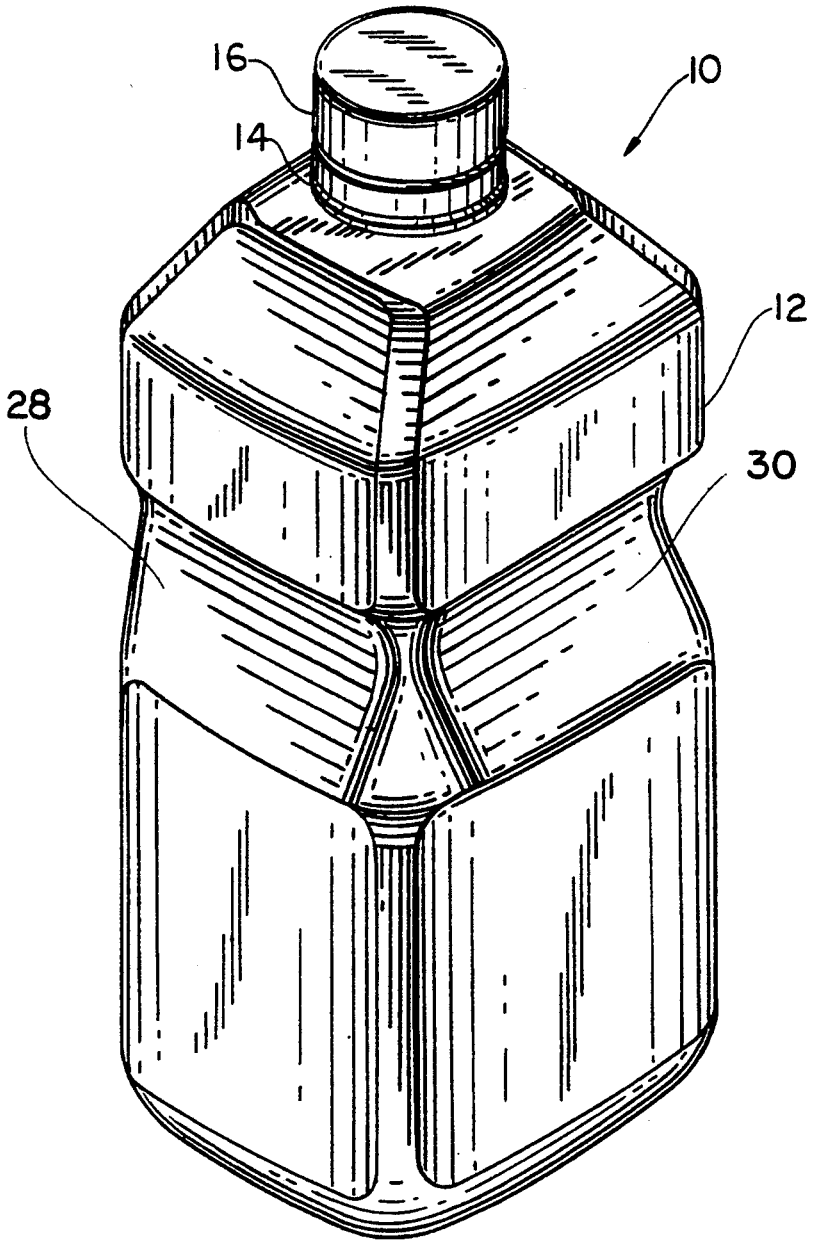
FIG. 7 shows an orthogonal view of the bottle of FIG. 1.

Referring now to FIGS. 1–7, a bottle 10 constructed in accordance with this invention includes an elongated body 12 terminating in a narrowing neck 14 with a closing cap 16. Body 12 is generally parallelepipedal in shape having a square cross section with rounded corners as seen in FIGS. 5 and 6.

Figure 1:
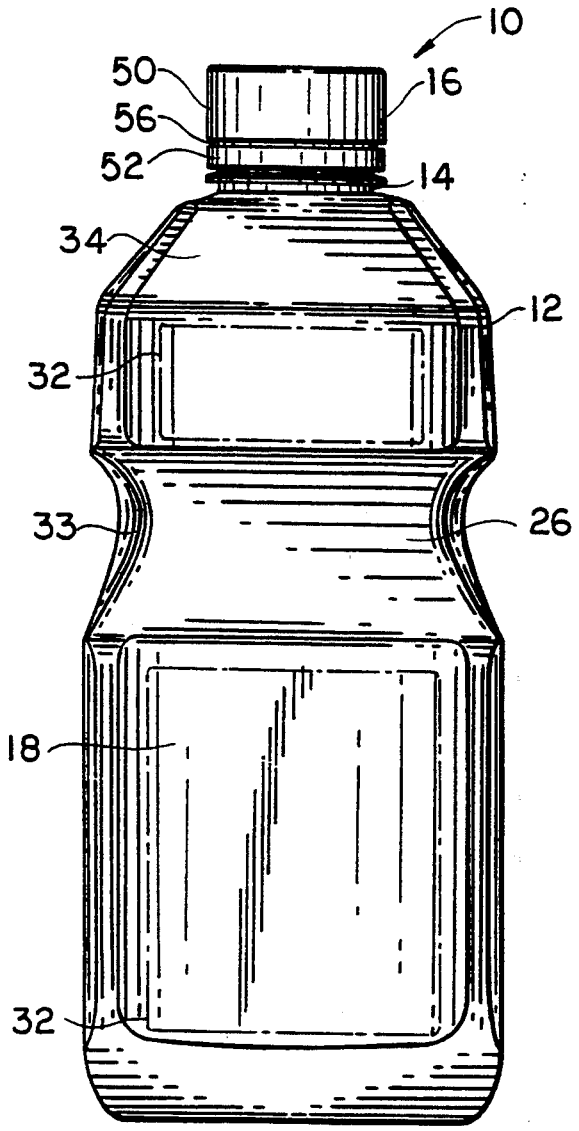
FIG. 1 shows front elevational view of a closed beverage bottle constructed in accordance with this invention.
Figure 2:
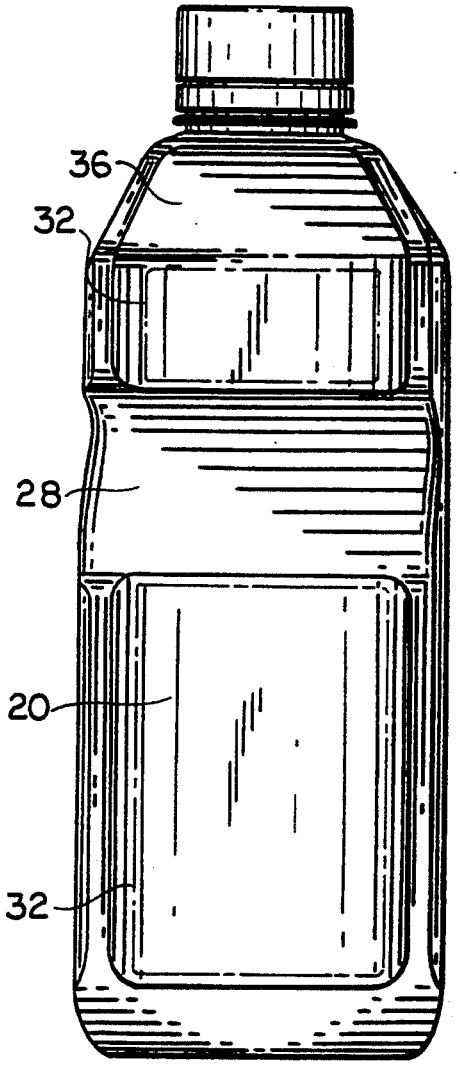
FIG. 2 shows a right side view of the bottle of FIG. 1.
Figure 3:
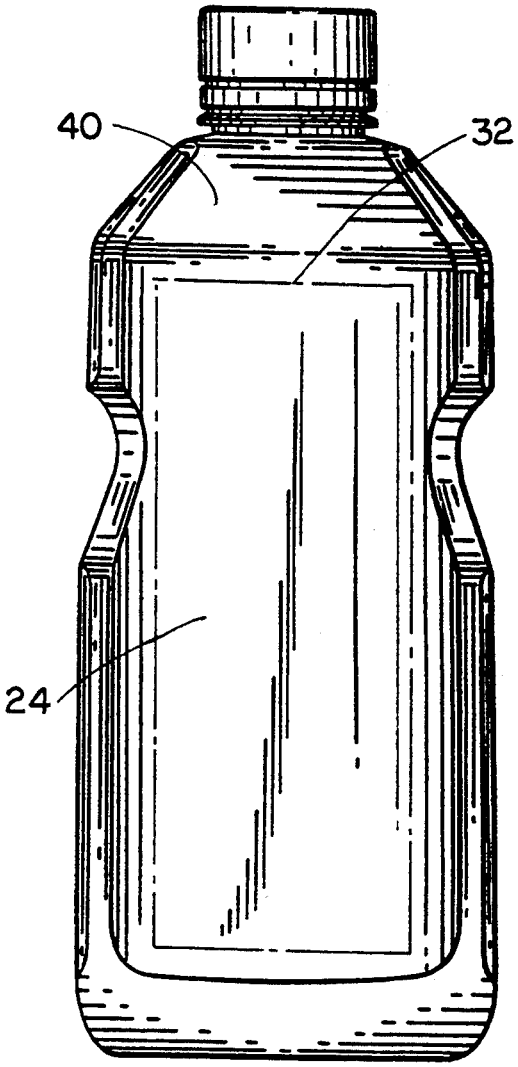
FIG. 3 shows a rear view of the bottle of FIG. 1.
Figure 4:
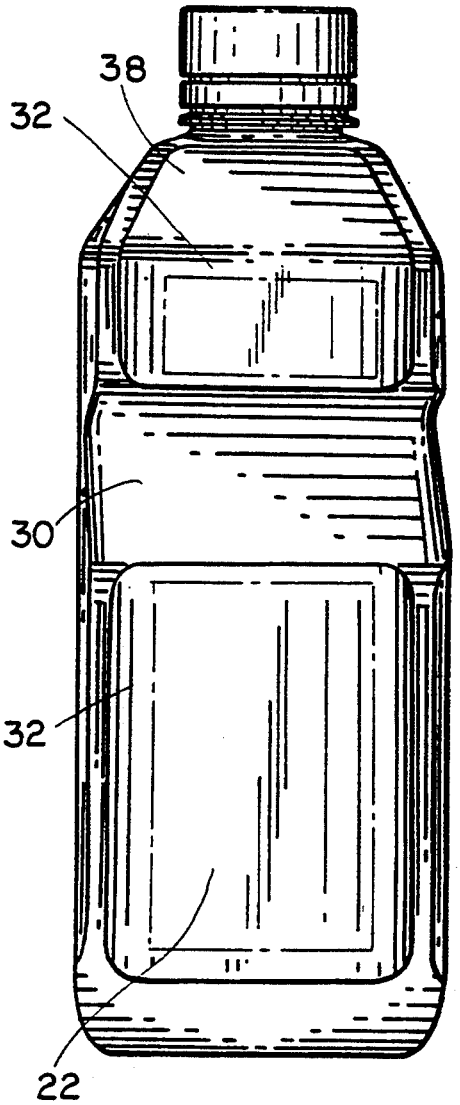
FIG. 4 shows a left side view of the bottle of FIG. 1.

Body 12 has four vertical side walls 18, 20, 22 and 24. Sidewalls 18, 20 and 22 are provided with horizontal grooves 26, 28, 30, respectively. These grooves have an arcuate cross section and form a continuous hand grip for the bottle 10 extending along three of its sides 18, 20, 22. For this purpose, these grooves 28 and 30 are disposed above the center of gravity of the bottle preferably about ⅓ of the height of the bottle from the top. The grooves are also sized and shaped so that a person can grasp the bottle easily with a thumb and forefinger of one hand. As shown in FIGS. 1 and 2, groove 26 disposed on wall 18 is much shallower and has larger radii of curvature than grooves 28 and 30. The geometric center of each groove 28 and 30 is dimpled so that is set inwardly, closer to the longitudinal axis of the bottle, as at 33.

Except for the grooves described above, the walls 18–24 have a substantially straight surface so that various labels 32 can be applied thereto identifying the product, bearing consumer information, and so forth.

Each of the sidewalls 18–24 terminate in an intermediate shoulder 34, 36, 38, 40 respectively sloping toward the bottle neck 14.

Figure 8:
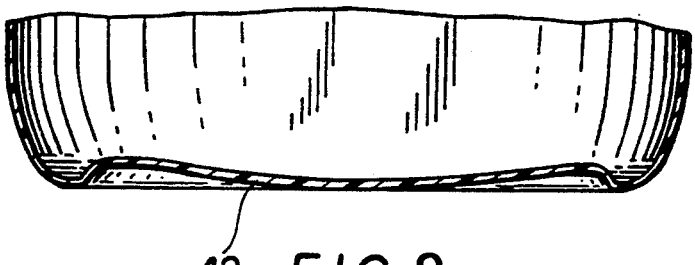
FIG. 8 shows a partial side-elevational cross sectional view of the bottle of FIG. 1.
Figure 9:
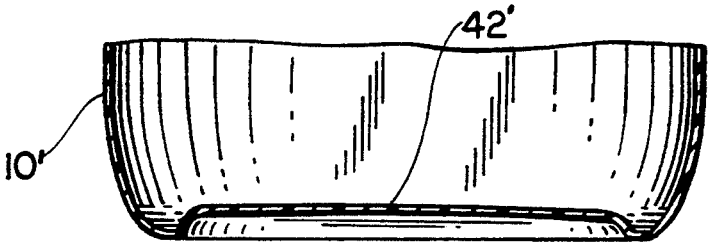
FIG. 9 shows a partial side-elevational cross sectional view of an alternate embodiment.

As shown in FIG. 8, the bottle 10 is provided with a bottom surface 42 which bulges outward to give more support and stability to the bottle. Alternatively, as shown in FIG. 9, bottle 10' may be provided with a straight bottom surface 42'.

Figure 10:
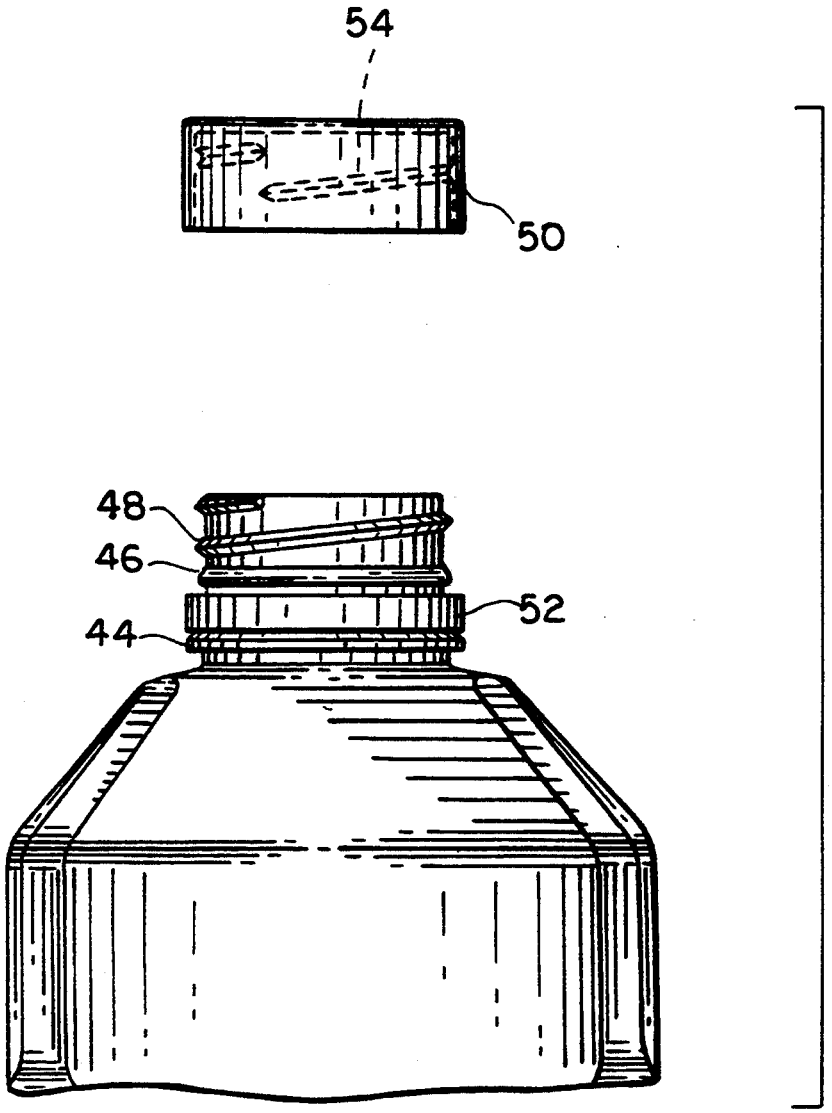
FIG. 10 shows a partial elevational view of the bottle of FIG. 1 with the closure removed.

As shown in FIG. 10, preferably neck 14 of the bottle 10 is generally cylindrical. On the lower portion, neck 14 is provided with a pair of annular ribs 44, 46. Above rib 46, neck 14 is provided with a helical outer thread 48.

In its turn, bottle closure 16 consists of an upper portion 50 and a lower portion 52. Upper portion 50 is cap shaped and is internally threaded as at 54 so that it can made with the upper section of neck 14. Lower closure portion 52 is merely a circular ring sized and shaped to fit between ribs 44, 46. Originally closure portions 50, 52 are joined by a frangible zone 56, the two portions being integrally molded with the frangible zone from a plastic material so that they form a single, unitary piece. As the closure 16 is applied to the neck 14 the lower portion 52 rides over rib 46 and is seated between the ribs 44, 46 as shown in FIG. 1. To open the bottle 10, the body 12 is held by a thumb and forefinger and the upper closure portion 50 is twisted off. This action causes the upper portion 50 to separate from the lower portion 52 along frangible portion 56. Lower portion 52 remains captive between ribs 44, 46 to provide a tampering indication, as shown in FIG. 10.

The body 12 is preferably molded of a plastic material such as PET or HDPE which may be readily recycled.

The above described beverage bottle has numerous advantages over the prior art. It can be sized and shaped to have the same volume and occupy the same space as a cardboard container but without the latter's disadvantages. It is tamper evident. It has a grip for holding it while the bottle is opened and while its contents are dispensed. It is easy to handle. When gripped, the bottle expands its overflow volume, thereby reducing the risk of spillage or squirting. The rib 44 provides a stop for the closure when the closure is initially mounted on the bottle, and further provides a means for holding the bottle and to intercept any drops from the mouth from running down the sides. The slanted shoulders provided a better control of the pouring operation preventing overturning the bottle and pouring out too much liquid. The sloped shoulders also prevent the gurgling sounds associated with standard carton containers with gable tops.

The three sided handle formed by the sidewall grooves is especially desirable because it requires less plastic material then if it would be continuous all around the bottle.

The four sides provide ample surface for various labels. Alternatively, labels for different products may be provided on different sides while using the same type of bottle.

The dimple in the center of each groove provides a positive feel for the customer during the handling of the bottle giving a better more sure control when picking up the bottle.

Because of the three sided construction, a customer can lift up a bottle easily with only two fingers. The bottle can be firmly grasped with either hand thereby eliminating bias towards right-handed or left-handed persons.

The grooves can be easily sized to fit the fingers of various people.

Obviously numerous modifications can be made to this invention without departing from its scope as defined in the appended claims.

We claim:

1. A plastic bottle for holding beverages comprising:

an elongated body; and a neck extending vertically above said body and having an access opening;

said body having a substantially square cross section defined by four side walls, each of said side wall having a substantially vertical planar surface and a substantially planar shoulder sloping toward said neck;

three of said side walls having a substantially horizontal arcuate groove extending across said vertical surface, the grooves on two opposed side walls being sized and shaped to fit a person's finger, and the groove on the third side wall being shallower and having a larger radius of curvature than the grooves on the opposed side walls to form a hand grip for holding said bottle while a liquid is dispensed from said opening.

2. The bottle of claim 1 wherein each groove is provided with a central dimple for acting as a guide for a person's finger.

3. The bottle of claim 1 wherein at least one sidewall is without a groove.

4. The bottle of claim 1 wherein said neck is cylindrical.

5. The bottle of claim 1 further including closure means for closing said opening.

6. The plastic bottle of claim 1 wherein said hand grip is disposed above a geometric center of said bottle.

7. The plastic bottle of claim 1 further comprising closure means for closing said bottle wherein said closure means includes tampering indication means.

8. A plastic bottle for beverages comprising:

a body having a substantially square cross section and defined by a first set of substantially planar sidewalls, each said first sidewall having a horizontal arcuate groove, said grooves of said first set of planar sidewalls extending partially around said bottle, the grooves on two opposed sidewalls being sized and shaped to fit a person's finger, and the groove on an intermediate side wall being shallower and having a larger radius of curvature than the grooves on the opposed side walls to define a hand grip for holding said bottle while a liquid is poured out of said bottle, said body further being defined by a second sidewall with no groove;

a plurality of slanted shoulders extending upwardly from said sidewalls;

a cylindrical neck terminating said shoulders; and a bottom wall.

9. The bottle of claim 8 wherein said grooves are disposed at about $\frac{1}{3}$ of the height of said bottle from the top.

10. The bottle of claim 8 wherein said neck includes a cylindrical neck wall with an outer surface, and an outer thread disposed on said outer surface.

11. The bottle of claim 10 further comprising a closure with an internal thread engaging said outer thread for closing said bottle.

12. The bottle of claim 11 wherein said neck further includes an annular rib and said closure includes a first portion disposed above said rib and a second portion disposed below said rib.

13. The bottle of claim 12 wherein said first portion and said second portion are coupled by a frangible portion which allows said first portion to separate from said second portion when said closure is unscrewed to provide tampering indication.

14. The bottle of claim 8 wherein said bottle is made of a moldable plastic material.

15. The bottle of claim 8 wherein each said groove extends substantially across the width of the corresponding sidewall.

* * * * *